US005722864A

United States Patent [19]

Andiarena

[11] Patent Number: 5,722,864

[45] Date of Patent: Mar. 3, 1998

[54] MARINE PROPULSION SYSTEM

[76] Inventor: Oscar Andiarena, 12340 SW. 39th Ter., Miami, Fla. 33175

[21] Appl. No.: 669,090

[22] Filed: Jun. 24, 1996

[51] Int. Cl.[6] ..... B63H 21/12

[52] U.S. Cl. ..... 440/5; 440/6; 440/67

[58] Field of Search ..... 440/3, 4, 38, 6, 440/67, 75; 416/177, 189

[56] References Cited

U.S. PATENT DOCUMENTS

| | | | |
|---|---|---|---|
| 472,199 | 4/1892 | Seabury | 440/67 |
| 1,805,597 | 5/1931 | Pratt | 440/5 |
| 3,914,629 | 10/1975 | Gardiner | 440/6 |
| 4,358,280 | 11/1982 | Jeanson et al. | 440/5 |
| 5,306,183 | 4/1994 | Holt et al. | 440/6 |
| 5,435,763 | 7/1995 | Pignata | 440/67 |

*Primary Examiner*—Stephen Avila
*Attorney, Agent, or Firm*—Joseph C. Mason, Jr.

[57] ABSTRACT

A marine propulsion system comprised of a housing unit having forward and rearward openings, a rotational unit, having forward and rearward openings and having an inner and outer periphery, rotatably secured in the housing unit such that the forward and rearward openings are aligned with the forwards and rearward openings of the housing unit, a plurality of blades rigidly secured to the inner periphery of the rotational unit, and drive means which rotate the rotational unit within the housing unit. Operation of the drive means causes the rotation of the rotational unit and the blades direct water into the forward openings of the housing unit and the rotational unit and out the rearward openings of the housing unit and rotational unit, thereby creating thrust.

11 Claims, 5 Drawing Sheets

MARINE PROPULSION SYSTEM

The present invention is the subject matter of U.S. Disclosure Document No. 356,593, filed in the United States Patent and Trademark Office on Jun. 8, 1994.

BACKGROUND OF THE INVENTION

1. Field of the Invention

The present invention is a marine propulsion system for watercraft. More particularly, the present invention relates to marine propulsion systems which have the propulsion blades internal to the housing of the system, as opposed to externally, such as with a typical marine propeller.

The present invention provides a significant improvement in that the system maximizes thrust with increased safety in that the moving parts of the system are internal and prevented from injurious contact with humans or marine animals.

2. Description of the Related Art

The prior art, as is known to the inventor, consists of either housed marine propellers or impellers which direct water through conduits for propulsion, or actual turbine jets.

U.S. Pat. No. 5,146,865 teaches a water-jet propulsion system for use in shallow water. More particularly, the water jet device has a centrally housed propeller directing the water through conduits to generate thrust.

U.S. Pat. No. 5,222,863 teaches a turbine multi-section hydrojet drive. The hydrojet compresses incoming water into its constituent gaseous components and then ignites the water-gas fluid. The expansive force of the burning water-gas fluid provides thrust, instead of the directive flow of water.

There are numerous other marine systems which have an internal drive means, however, they are non-analogous to the present system. None of these, nor other references known to the inventor, address the problem solved by the instant invention, that is, provide a marine propulsion system which maximizes safety and thrust.

SUMMARY OF THE INVENTION

The present invention relates to a marine propulsion system, the marine propulsion system comprising a housing unit which has forward and rearward openings, a rotational unit, which has forward and rearward openings and also has an inner and outer periphery, rotatably secured in the housing unit such that the forward and rearward openings are aligned with the forward and rearward openings of the housing unit, a plurality of blades rigidly secured to the inner periphery of the rotational unit, and drive means which rotate the rotational unit within the housing unit. Whereby, operation of the drive means causes the rotation of the rotational unit and the blades which directs the water into the openings of the housing unit and the rotational unit and out the rear openings of the rotational unit and housing unit, thereby creating thrust.

It is an object of the present invention to provide a marine propulsion system which maximizes safety in that its moving parts are internal to the housing of the system and cannot be contacted by humans or by large marine animals.

It is another object of the present invention to provide a marine propulsion system which maximizes thrust by having the directive blades rigidly attached to the inner periphery of a rotating unit, thereby minimizing cavitation from the propeller as the blades rotate.

It is yet another object of the present invention to provide a marine propulsion system which can operate silently to prevent the harassment of marine life due to decreased cavitation.

It is yet a further object of the present invention to provide a marine propulsion system which can operate stealthily to avoid detection by marine sonar and listening devices.

It is yet another object of the present invention to provide a marine propulsion system which maximizes thrust to economize energy spent in propelling the water craft.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
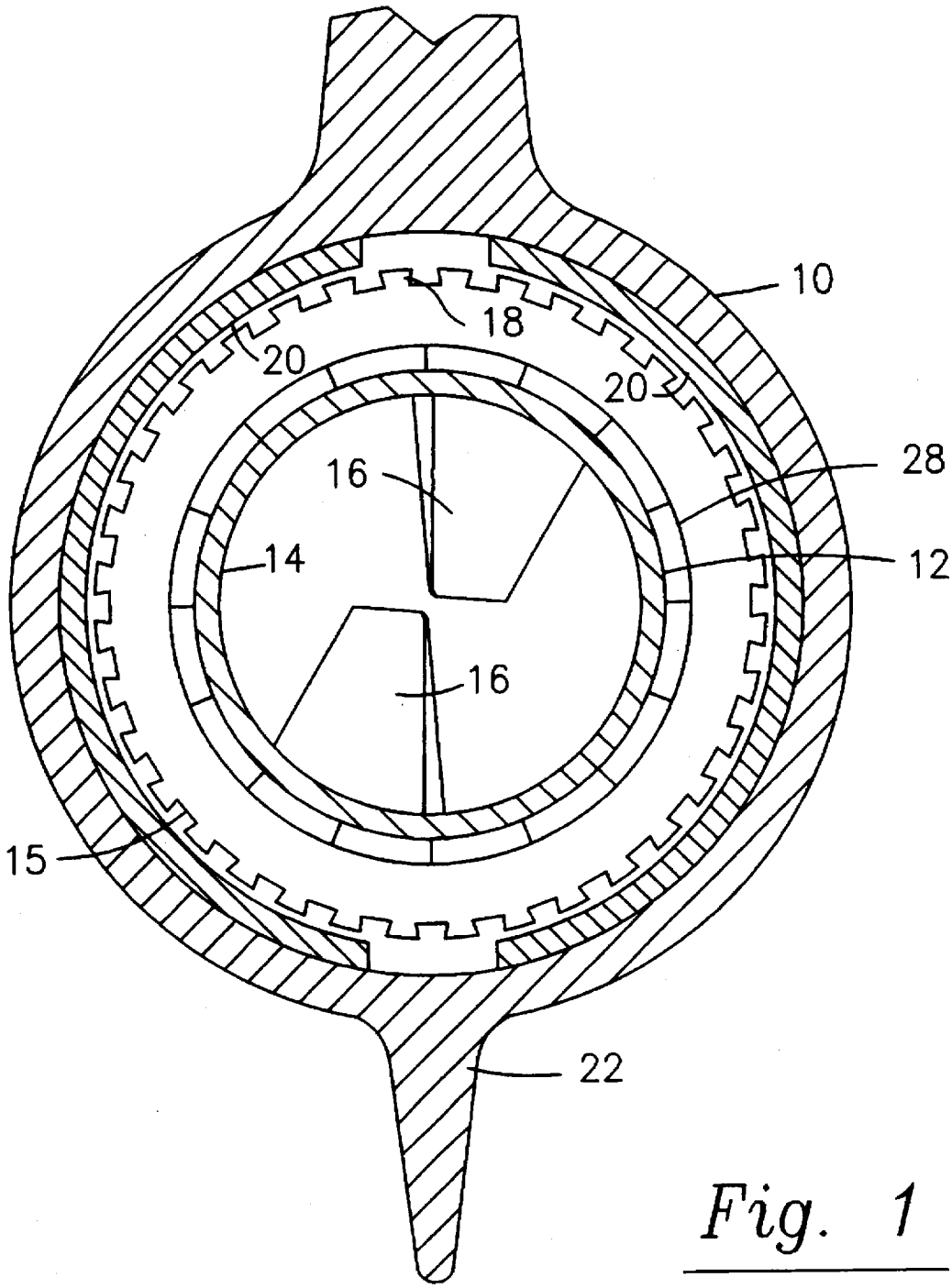
FIG. 1 is a front view of the marine propulsion system utilizing integrated electrical drive means.

As seen in FIG. 1, the marine propulsion system comprises a housing 10 which is submerged in the water. The housing 10 has a rotational unit, preferably a cylinder 12, which is rotatably secured within the housing 10. The cylinder 12 has an inner periphery 14 and an outer periphery. Rigidly attached to the inner periphery are a plurality of blades, here two blades 16. The plurality of blades is ideally equidistant from each other, although such arrangement is not essential. The propulsion system may by constructed from any rigid material, however, the optimal construction material is light weight metal, such as aluminum or titanium, for its strength and lesser cost.

The marine propulsion system can be used in a outboard, inboard/outboard, or inboard configuration, so long as the housing 10 and cylinder 12 are immersed in the water. However, it is possible to have the cylinder 12 out of the water and have conduits directing water to and from the cylinder 12, which configuration is common in personal watercraft (known as jet skis). In such configuration, the instant system performs the same function as an impeller, but with increased efficiency in thrust.

The overall size of the system may vary depending upon the specific use for the engine and performance capabilities sought.

Any suitable drive means which can rotate the cylinder 12 may be used. For example, mechanical linkage, such as gears, belts or chains, to internal combustion engines, turbines, or electric motors may be used to rotate the cylinder 12. Further, as seen in FIGS. 1 and 2, the cylinder 12 may be configured as an electric motor.

In such configuration, the cylinder 12 has fixed magnets 18 about the outer periphery 15 and a stator 20 within the housing 10. Thus, the marine system becomes a simple electric motor in that direct current is applied to the stator 20 and the cylinder 12 rotates in accord with the magnetic flux induced by the fixed magnets 18.

Figure 2:
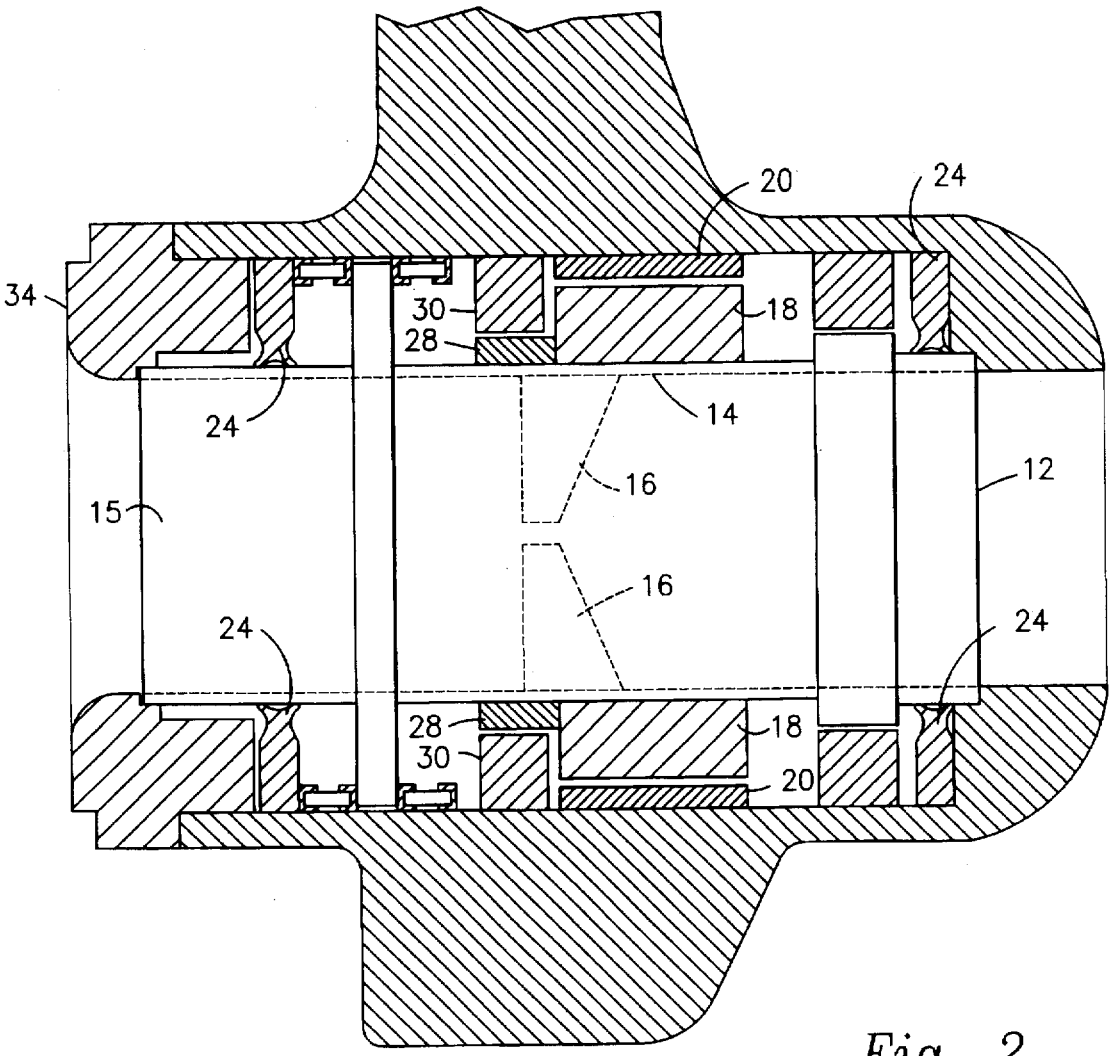
FIG. 2 is a side view of the marine propulsion system of FIG. 1.

More particularly, the integrated electric drive means as seen in FIG. 2 has a commutator 28, electric brush 30 and fixed magnets 18 about the outer periphery 15 of the cylinder 12. The housing 10 has a stator 20 surrounding the outer periphery 15 and fixed magnets 18. Upon application of direct current to the commutator 28, magnetic flux occurs in the fixed magnets 18 in relation to the stator 20, which thereby causes the cylinder 12 to rotate in cycle with the direct current. As such, the instant system itself functions as a DC motor, with the cylinder 12 as the rotor. It is also possible to configure the system as an AC reluctance motor.

Configured as an AC reluctance motor, the stator 20 inside the housing 10 would have rectangular extensions about its outer periphery 15 and the housing 10 would have identical rectangular extensions surrounding, but not in contact with, the extensions of the outer periphery 15, which become the stator. Thus, when an alternating current is applied to the stator 20, instead of the commutator 28 of the DC motor, the mutual electromagnetic attraction and repulsion of the rectangular protrusions causes rotation of the cylinder 12.

The cylinder 12 is rotatably secured in the housing 10 through sleeve bearings 11. The drive components are kept water-free through the use of seals 24 placed around the outer periphery 15 of the cylinder 12, towards the forward 36 and rearward 14 openings of the cylinder 12. The seals 24 are ideally constructed from rubber, but may be made from plastic, rubber, silicon, or some type of petroleum lubricant which, being hydrophobic in nature, crates a water-tight seal around the cylinder 12 within the housing 10, yet allows non-abrasive rotation of the cylinder 12.

Figure 3:
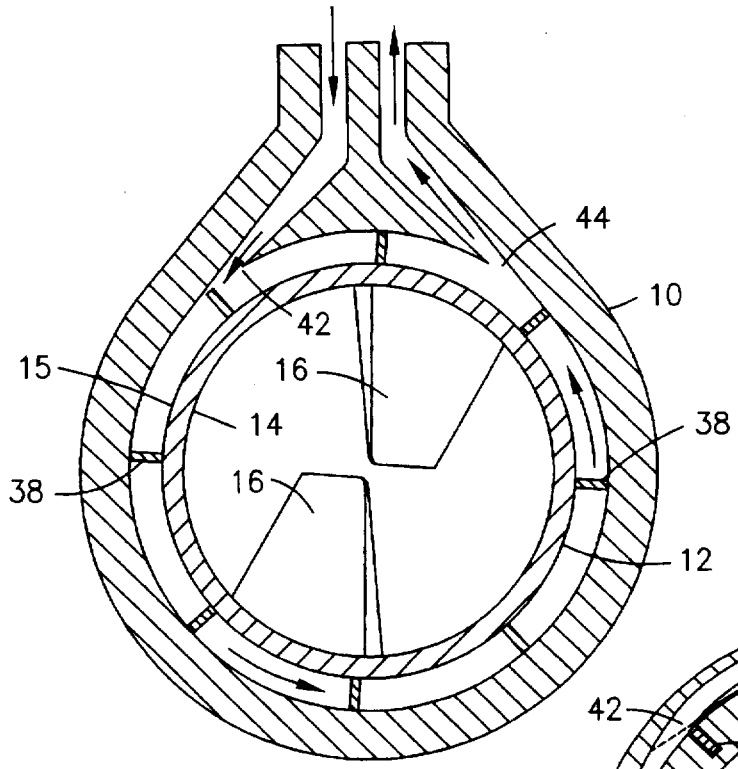
FIG. 3 is a front view of the marine propulsion system utilizing compressed fluid drive means.
Figure 3A:
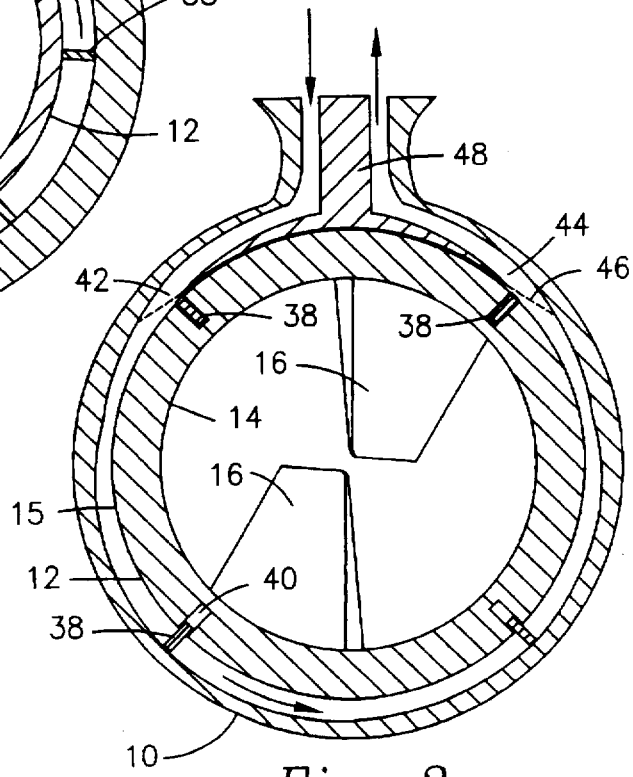
FIG. 3A if a front view of an alternate embodiment of the marine propulsion system of FIG. 3.
Figure 4:
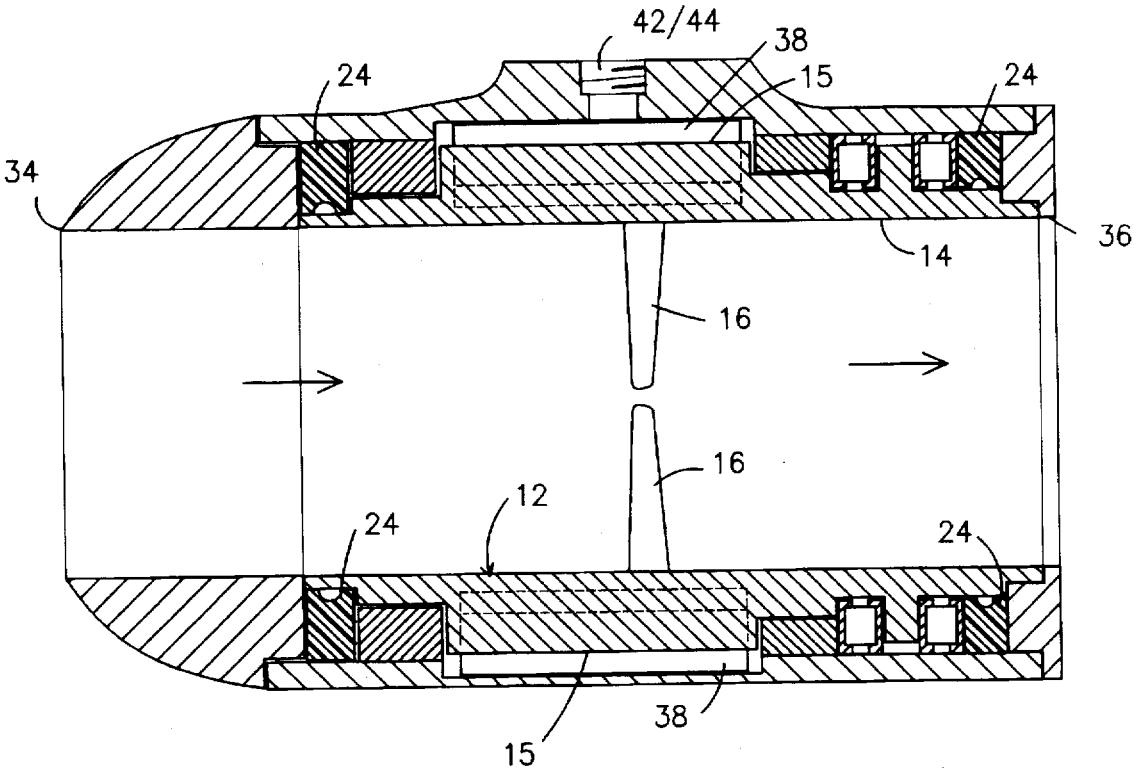
FIG. 4 is a side view of the marine propulsion system of FIGS. 3 and 3A.

Referring to FIG. 3, the drive means may also be a compressed fluid with flows around the outer periphery of the cylinder 12. The fluid may be steam, hydraulic fluid, or some other fluid or gas which resists compression. The compressed fluid typically will be compressed at a source external to the housing 10. The compressed fluid flows from the source 42, under pressure, and enters the space 56 between the housing 10 and cylinder 12, as seen in FIG. 3A.

As shown in FIG. 3, the cylinder 12 has vanes 38 about its outer periphery 15. The vanes 38 are spaced about the outer periphery 15 of the cylinder 12 and contact the housing 10 at the vanes 38 outer edges. The compressed fluid contacts the vanes 38 and outer periphery 15 of the cylinder 12 through inport 42. The vanes 38 do not extend the entire length of the cylinder 12, so the cylinder 12 still rotatably secured in sleeve bearings 11.

The vanes 38 are spaced about the outer periphery 15 of the cylinder 12 forming a space 56, between the vanes 38, the outer periphery 15 of the cylinder 12, and the housing 10. The length of the space 56 is less than the distance between the inport 42 and outport 44. This allows the circulating fluid to enter the inport 42 and flow into the space 56, contact the vanes 38 and cause the cylinder 12 to rotate in response to the impact of the circulating fluid on the vanes 38. Because the space 56 cannot encompass both inport 42 and outport 44 simultaneously, the force from the incoming circulating fluid will cause greater pressure as it impacts the vanes 38, and that pressure may only be released upon rotation of that space 56 to the outport 44.

As the vanes 38 are in constant contact with the housing 10, they are preferably made from a light alloy, such as aluminum, titanium, or possible from a ceramic material, and have a lubricative coating, such as graphite, petroleum, or silicon, to minimize friction with the housing 10. The circulating fluid itself may also serve a lubricant depending upon its viscosity at various temperature ranges. A viscous fluid such as hydraulic fluid will serve to lubricate the housing 10 sufficiently to minimize friction of the vanes 38.

The compressed fluid drive means may also be embodied as in FIG. 3A, where housing 10 includes an extension 48 between inport 42 and outport 44 which contacts the cylinder 12. The vanes 38 have urging means 40 between themselves and the cylinder 12. The urging means 40 keep the vanes 38 in constant contact with the housing 10, while allowing the vanes 38 to retreat into the outer periphery 15 of the cylinder 12.

Upon rotation of the cylinder 12 towards the outport 44, the surface 46 of the housing 10 slopes to force the vanes 38 flush with the outer periphery 15 of the cylinder 12. Thus, extension 48 of the housing 10 prevents the circulating fluid, at high pressures, from leaking directly from the inport 42 to outport 44.

The urging means 40 of the vanes 38 may be any means which resists compression. One can use mechanical means, such as a spring, or a pressurized gaseous pocket between the vane 38 and the cylinder 12.

Figure 5:
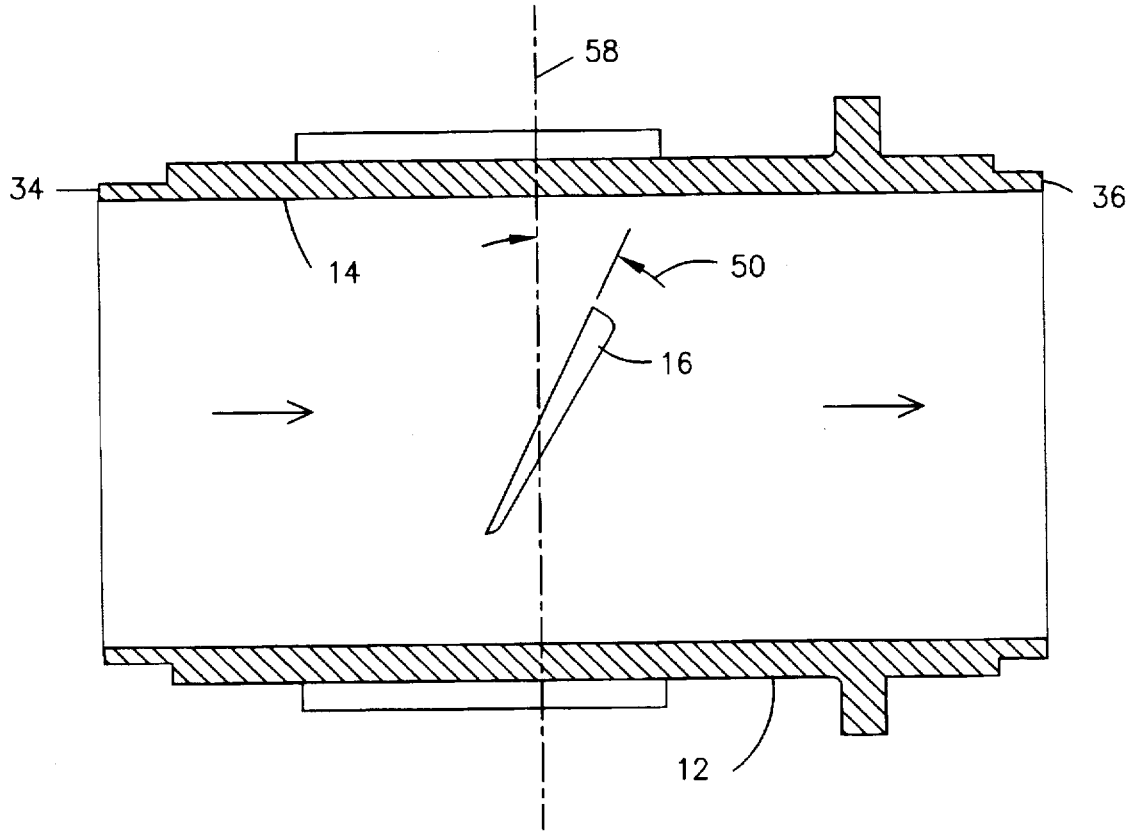
FIG. 5 is a top view of a blade as its extends from the inner periphery of the cylinder.

As seen in FIG. 5, the blades 16 are fixed at an angle 50 from a line 58 perpendicular to the length of the cylinder 12. This angle 50 allows for the generation of thrust by the blades 16 forcing water through the cylinder 12. The angle 50 is optimal in a range of 23 to 32 degrees from the perpendicular line 58. The blades 16 may also be shaped in a manner to enhance thrust capabilities, such as having a curve through their body or altering the shape of the leading edges. The variances in shape and curvature may also help to further lessen cavitation.

While there has been shown the preferred and alternate embodiments of the present invention, it is to be understood that the invention may be embodied otherwise than is herein specifically shown and described, and that within said embodiments, certain changes may be made in the form and arrangements of the parts without departing form the underlying ideas or principles of this invention as set forth in the claims appended herewith.

Having thus described my invention, what I claim as new, useful, non-obvious, and accordingly, secure by Letters Patent of the United States is:

1. A marine propulsion system, comprising:

a housing unit having forward and rearward openings;

a rotational unit, having forward and rearward openings and having an inner and outer periphery, rotatably secured in said housing unit such that said forward and rearward openings are aligned with said forward and rearward openings of said housing unit;

a plurality of blades rigidly secured to said inner periphery of said rotational unit at an angle of 23 to 32 degrees from a line parallel to said forward and rearward openings of said rotational unit; and drive means which rotates said rotational unit within said housing unit;

whereby, operation of said drive means causes the rotation of said rotational unit and said blades direct water into said forward openings of said housing unit and said rotational unit and out said rearward openings of said housing unit and said rotational unit, thereby creating thrust.

2. The marine propulsion system as recited in claim 1, wherein said drive means is mechanical linkage to an internal combustion engine.

3. The marine propulsion system as recited in claim 1, wherein said drive means is mechanical linkage to an electric motor.

4. The marine propulsion system as recited in claim 1, wherein said drive means is:

conductive coils within said housing unit; and magnets rigidly attached to said outer periphery of said rotational unit;

whereby, upon supply of electricity to said coils, said coils cause magnetic flux in said magnets and the attraction of said magnets to said coils operates to rotate said rotational unit.

5. The marine propulsion system as recited in claim 1, wherein said drive means is compressed fluid directionally circulated around the outer periphery of said rotational unit to effectuate rotation of said rotational unit.

6. The marine propulsion system as recited in claim 1, wherein said drive means is steam directionally circulated around the outer periphery of said rotational unit to effectuate rotation of said rotational unit.

7. The marine propulsion system as recited in claim 1, wherein said rotational unit is a tube.

8. The marine propulsion system as recited in claim 7, wherein said tube is a cylinder.

9. The marine propulsion system as recited in claim 1, wherein said plurality of blades are spaced apart an approximately equal distance from each other.

10. The marine propulsion system as recited in claim 1, wherein said plurality of blades is two blades.

11. The marine propulsion system as recited in claim 1, wherein said plurality of blades are shaped to maximize the flow of water through said housing unit and said rotational unit.

* * * * *